US010745236B2

(12) United States Patent
Suzuki et al.

(10) Patent No.: US 10,745,236 B2
(45) Date of Patent: Aug. 18, 2020

(54) SHEET PROCESSING APPARATUS AND IMAGE FORMING SYSTEM INCORPORATING THE SAME

(71) Applicants: Michitaka Suzuki, Kanagawa (JP); Shinji Asami, Tokyo (JP); Tomohiro Furuhashi, Kanagawa (JP); Tomomichi Hoshino, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takuya Morinaga, Tokyo (JP); Yohsuke Haraguchi, Kanagawa (JP)

(72) Inventors: Michitaka Suzuki, Kanagawa (JP); Shinji Asami, Tokyo (JP); Tomohiro Furuhashi, Kanagawa (JP); Tomomichi Hoshino, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takuya Morinaga, Tokyo (JP); Yohsuke Haraguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/224,980

(22) Filed: Dec. 19, 2018

(65) Prior Publication Data

US 2019/0284009 A1 Sep. 19, 2019

(30) Foreign Application Priority Data

Mar. 19, 2018 (JP) ..... 2018-050998

(51) Int. Cl.
*B65H 45/04* (2006.01)
*B65H 45/14* (2006.01)
(Continued)

(52) U.S. Cl.
CPC ..... *B65H 45/04* (2013.01); *B65H 9/006* (2013.01); *B65H 29/145* (2013.01); *B65H 45/14* (2013.01);
(Continued)

(58) Field of Classification Search
CPC ..... B65H 45/04; B65H 45/147; B65H 2701/13212; B65H 2801/27; G03G 15/6564; G03G 2215/00877
See application file for complete search history.

(56) References Cited

U.S. PATENT DOCUMENTS 4,436,302 A * 3/1984 Frye ..... B65H 29/6627 271/183
5,112,034 A * 5/1992 Uto ..... B65H 29/60 270/58.12
(Continued)

FOREIGN PATENT DOCUMENTS

JP H01-226653 A 9/1989
JP H03-259827 A 11/1991
(Continued)

OTHER PUBLICATIONS

Extended European Search Report dated Jun. 26, 2019.
Chinese Office Action dated Apr. 20, 2020.

*Primary Examiner* — Leslie A Nicholson, III
(74) *Attorney, Agent, or Firm* — Harness, Dickey & Pierce, P.L.C.

(57) ABSTRACT

A sheet processing apparatus includes conveyers to convey a sheet. The conveyers include a registration conveyer which a plurality of sheets is to sequentially contact and is configured to bend a preceding sheet contacting the registration conveyer toward a direction in which the preceding sheet does not obstruct an entry of a following sheet to the registration conveyer when the conveyers overlay and con-
(Continued)

vey the plurality of sheets after the plurality of sheets sequentially contacts the registration conveyer.

17 Claims, 14 Drawing Sheets

(51) Int. Cl.
*G03G 15/00* (2006.01)
*B65H 29/14* (2006.01)
*B65H 9/00* (2006.01)

(52) U.S. Cl.
CPC ..... *B65H 45/147* (2013.01); *G03G 15/6564* (2013.01); *B65H 2301/4213* (2013.01); *B65H 2301/42142* (2013.01); *B65H 2701/13212* (2013.01); *B65H 2701/182* (2013.01); *B65H 2801/27* (2013.01); *G03G 2215/00877* (2013.01)

(56) References Cited

U.S. PATENT DOCUMENTS 5,738,349 A 4/1998 Shirasaki
5,967,506 A * 10/1999 Miki ..... B65H 9/06 271/10.13
6,332,606 B1 * 12/2001 Seki ..... B42C 1/12 270/58.08
6,338,481 B1 * 1/2002 Maruchi ..... B65H 29/70 271/188
6,390,467 B1 * 5/2002 Fukube ..... B65H 9/006 271/256
6,554,216 B1 * 4/2003 Escobedo ..... B41J 11/46 198/624
6,698,752 B1 3/2004 Kakuta et al.
7,306,214 B2 * 12/2007 Iida ..... B65H 29/60 270/58.01
7,896,341 B2 3/2011 Kunieda et al.
7,900,905 B2 * 3/2011 Kiriyama ..... B42C 1/125 270/58.02
8,172,214 B2 * 5/2012 Kubota ..... B42C 1/125 270/58.07
8,960,665 B2 * 2/2015 Nishimura ..... G03G 15/6529 271/184
2007/0290427 A1 12/2007 Horii et al.
2008/0224386 A1 9/2008 Kunieda et al.
2008/0258373 A1 10/2008 Wakabayashi et al.
2010/0187742 A1 7/2010 Sekigawa
2014/0138899 A1 5/2014 Oyama et al.
2014/0203486 A1 7/2014 Sugiyama et al.
2014/0203487 A1 7/2014 Hoshino et al.
2014/0203488 A1 7/2014 Hidaka et al.
2014/0206516 A1 7/2014 Hata et al.
2014/0206517 A1 7/2014 Kikuchi et al.
2014/0206518 A1 7/2014 Hidaka et al.
2014/0206519 A1 7/2014 Hoshino et al.
2014/0213425 A1 7/2014 Sugiyama et al.
2014/0336031 A1 11/2014 Suzuki et al.
2014/0364295 A1 12/2014 Watanabe et al.
2015/0031520 A1 1/2015 Nakada et al.
2015/0225201 A1 8/2015 Watanabe et al.
2015/0266697 A1 9/2015 Saito et al.
2016/0060072 A1 3/2016 Watanabe et al.
2016/0068359 A1 3/2016 Suzuki et al.
2016/0114999 A1 4/2016 Suzuki et al.
2016/0115000 A1 4/2016 Sugiyama et al.
2018/0201466 A1 7/2018 Saito et al.
2018/0236744 A1 8/2018 Suzuki et al.
2018/0257900 A1 9/2018 Suzuki et al.

FOREIGN PATENT DOCUMENTS

JP H08-151144 A 6/1996
JP H08-151145 A 6/1996
JP H10-194530 A 1/1998
JP 2004-026353 A 1/2004
JP 3762849 B2 4/2006
JP 2008-285239 A 11/2008
JP 2009-067537 A 4/2009
JP 2013-159438 A 8/2013
JP 2014-101186 A 6/2014
JP 2014-125312 7/2014
JP 2015-016920 1/2015
JP 6089690 B2 3/2017

* cited by examiner

SHEET PROCESSING APPARATUS AND IMAGE FORMING SYSTEM INCORPORATING THE SAME

CROSS-REFERENCE TO RELATED APPLICATION

This patent application is based on and claims priority pursuant to 35 U.S.C. § 119 to Japanese Patent Application No. 2018-050998, filed on Mar. 19, 2018 in the Japanese Patent Office, the entire disclosure of which is hereby incorporated by reference herein.

BACKGROUND

Technical Field

This disclosure relates to a sheet processing apparatus and an image forming system incorporating the sheet processing apparatus.

Description of the Related Art

Conventionally, a sheet processing apparatus includes a conveyer to convey a sheet. After a plurality of sheets sequentially contacts the conveyer, the conveyer conveys the plurality of sheets overlaid one on another.

SUMMARY

This specification describes an improved sheet processing apparatus that includes conveyers to convey a sheet. The conveyers include a registration conveyer which a plurality of sheets is to sequentially contact and is configured to bend a preceding sheet contacting the registration conveyer toward a direction in which the preceding sheet does not obstruct an entry of a following sheet to the registration conveyer when the conveyers overlay and convey the plurality of sheets after the plurality of sheets sequentially contacts the registration conveyer.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
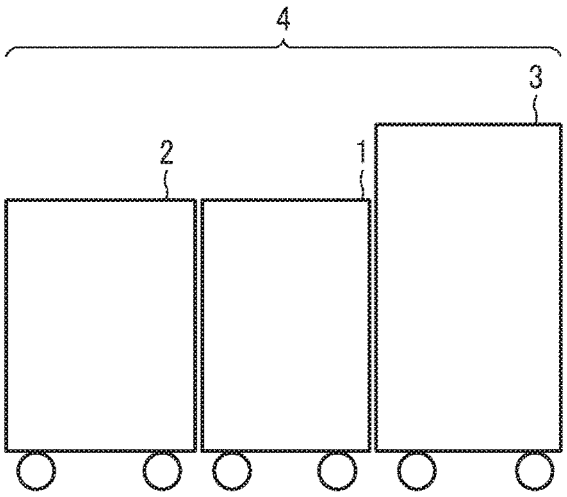
FIG. 1 is a schematic diagram illustrating a system configuration of an image forming system including an image forming apparatus and a plurality of sheet processing apparatuses according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

FIG. 1 is a schematic diagram illustrating a system configuration of an image forming system 4 according to an embodiment of the present disclosure, including an image forming apparatus and a plurality of sheet processing apparatuses. The image forming system 4 in the present embodiment includes a folding processing apparatus 1 and a post-processing apparatus 2, each of which serves as the sheet processing apparatus, provided in this order at later stages of the image forming apparatus 3, as illustrated in FIG. 1.

The image forming apparatus 3 forms an image on a sheet based on image data that is input to the image forming apparatus 3 or obtained by scanning. The image forming apparatus 3 may be, for instance, a copier, a printer, a facsimile machine, or a multifunction peripheral having at least two functions of the foregoing machines. The image forming apparatus 3 may use any known image forming method, such as electrophotography or droplet discharge. The image forming apparatus 3 in the present embodiment is a copier using an electrophotographic method.

Examples of the post-processing apparatus 2 include a punch apparatus that punches a hole in the sheet, a sheet binding apparatus in which a stapler or the like binds sheets and make a sheet bundle, and a sorter that sorts and discharges a sheet on which an image formed into each of a plurality of discharge trays.

Figure 2:
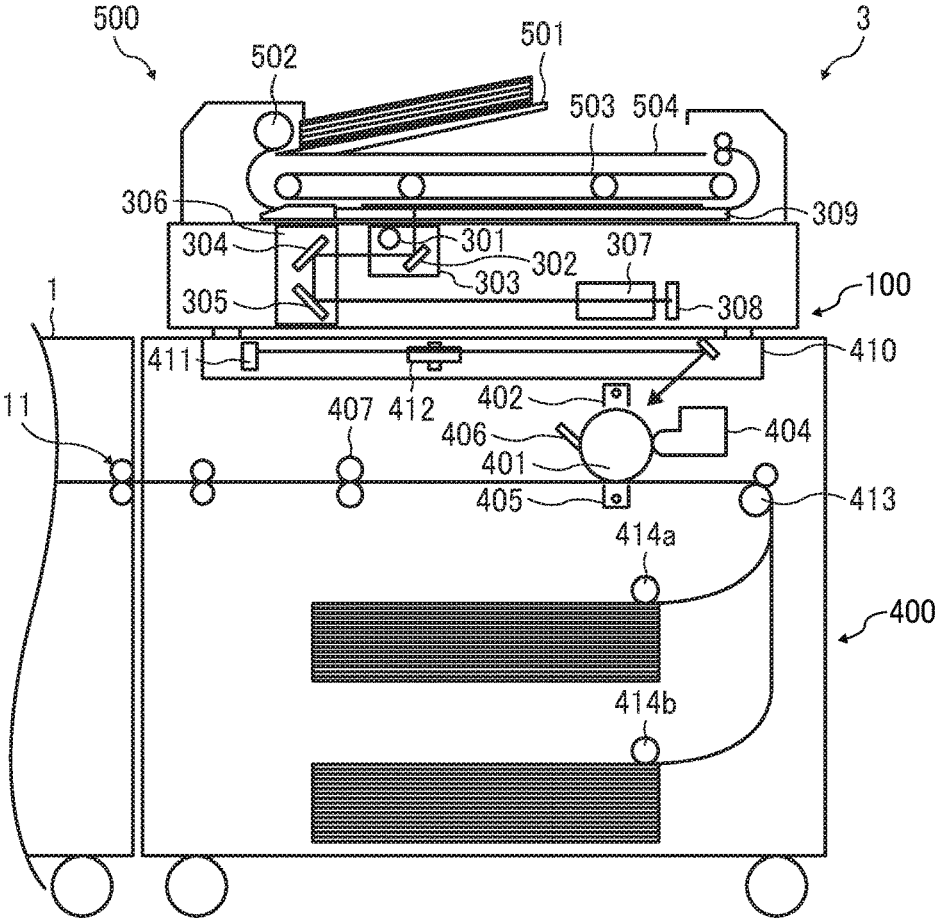
FIG. 2 is a schematic configuration diagram of an image forming apparatus provided in the image forming system of FIG. 1.

FIG. 2 is a schematic configuration diagram of the image forming apparatus 3 provided in the image forming system 4 according to the present embodiment.

In an image forming apparatus main body 400, feeding cassettes to store sheets serving as recording media are disposed below an image forming section. After a sheet stored in each of the feeding cassettes is fed by the feeding roller 414*a* or 414*b*, the sheet is conveyed upward along a predetermined conveyance path. Then the sheet reaches a registration roller pair 413.

The image forming section includes a photoconductor drum 401 as an image bearer, a charger 402, an exposure device 410, a developing device 404, a transfer device 405, and a cleaner 406.

The charger 402 uniformly charges a surface of the photoconductor drum 401. The exposure device 410 forms an electrostatic latent image on the photoconductor drum 401 based on image data read by a scanner 100. The developing device 404 adheres toner to the electrostatic latent image formed on the photoconductor drum 401 to form a visible image as a toner image. The transfer device 405 transfers the toner image from the photoconductor drum 401 onto the sheet. The cleaner 406 removes toner remaining on the photoconductor drum 401 after the transfer.

On the downstream side of the image forming section in the sheet conveyance direction, a fixing device 407 to fix the toner image on the sheet is disposed.

The exposure device 410 includes a laser unit 411 to emit a laser beam based on the image data under a control of a controller and a polygon mirror 412 to scan the laser beam from the laser unit 411 in a rotation axis direction of the photoconductor drum 401 which is called a main scanning direction.

An automatic document feeder 500 is mounted on the scanner 100. The automatic document feeder 500 includes a platen 501, a separation and feed roller 502, an original conveyor belt 503, and an original ejection tray 504.

When the automatic document feeder 500 receives an instruction to start scanning originals placed on the platen 501, the separation and feed roller 502 feeds the originals one by one from the platen 501 to the original conveyor belt 503. The original conveyor belt 503 moves the originals onto a platen glass 309 on which each of the originals temporally stops.

Then, the scanner 100 reads the image data of the original temporarily stopped on the platen glass 309. Thereafter, the original conveyor belt 503 resumes conveyance of the original to eject the original onto the original ejection tray 504.

In addition to the platen glass 309, the scanner 100 includes a first carrier 303, a light source 301 and a mirror 302 provided on the first carrier 303, a second carrier 306, mirrors 304 and 305 provided on the second carrier 306, a lens 307, and a charge coupled device (CCD) 308. The light source 301 is lighted when the automatic document feeder 500 conveys the original onto the platen glass 309 or when a user places an original on the platen glass 309 and directs the image forming apparatus 3 to start copying via an operation panel. In the meantime, the first carrier 303 and the second carriers 306 move along a guide rail.

The light source 301 emits light to the original positioned on the platen glass 309. Reflection light from the original is guided to the CCD 308 via the mirror 302, the mirrors 304 and 305, and the lens 307. The CCD 308 receives the reflection light and reads the image data of the original. The image data is converted from analog to digital data by an analog-to-digital (A/D) converter. The digital data is sent from a data output unit to the controller in the image forming apparatus main body 400.

On the other hand, the image forming apparatus main body 400 starts to drive the photoconductor drum 401, and after a rotation speed of the photoconductor drum 401 reaches a predetermined speed, the charger 402 uniformly charges the surface of the photoconductor drum 401. The exposure device 410 forms the electrostatic latent image on the charged surface of the photoconductor drum 401 based on the image data read by the scanner 100.

Thereafter, the developing device 404 develops the electrostatic latent image on the surface of the photoconductor drum 401 into a toner image. In the meantime, the feeding roller 414*a* or 414*b* feeds the sheet stored in the feeding cassette, and the registration roller pair 413 temporarily stops the sheet.

The registration roller pair 413 feeds the sheet to a transfer portion opposed to the transfer device 405 when a leading edge of the toner image formed on the surface of the photoconductor drum 401 reaches the transfer portion. While the sheet passes through the transfer portion, a transfer electric field transfers the toner image formed on the surface of the photoconductor drum 401 onto the sheet.

The sheet on which the toner image is transferred is conveyed to the fixing device 407, subjected to a fixing process by the fixing device 407, and then discharged to the folding processing apparatus 1 at the subsequent stage. The cleaner 406 removes residual toner which is not transferred onto the sheet at the transfer portion and remains on the surface of the photoconductor drum 401.

Figure 3:
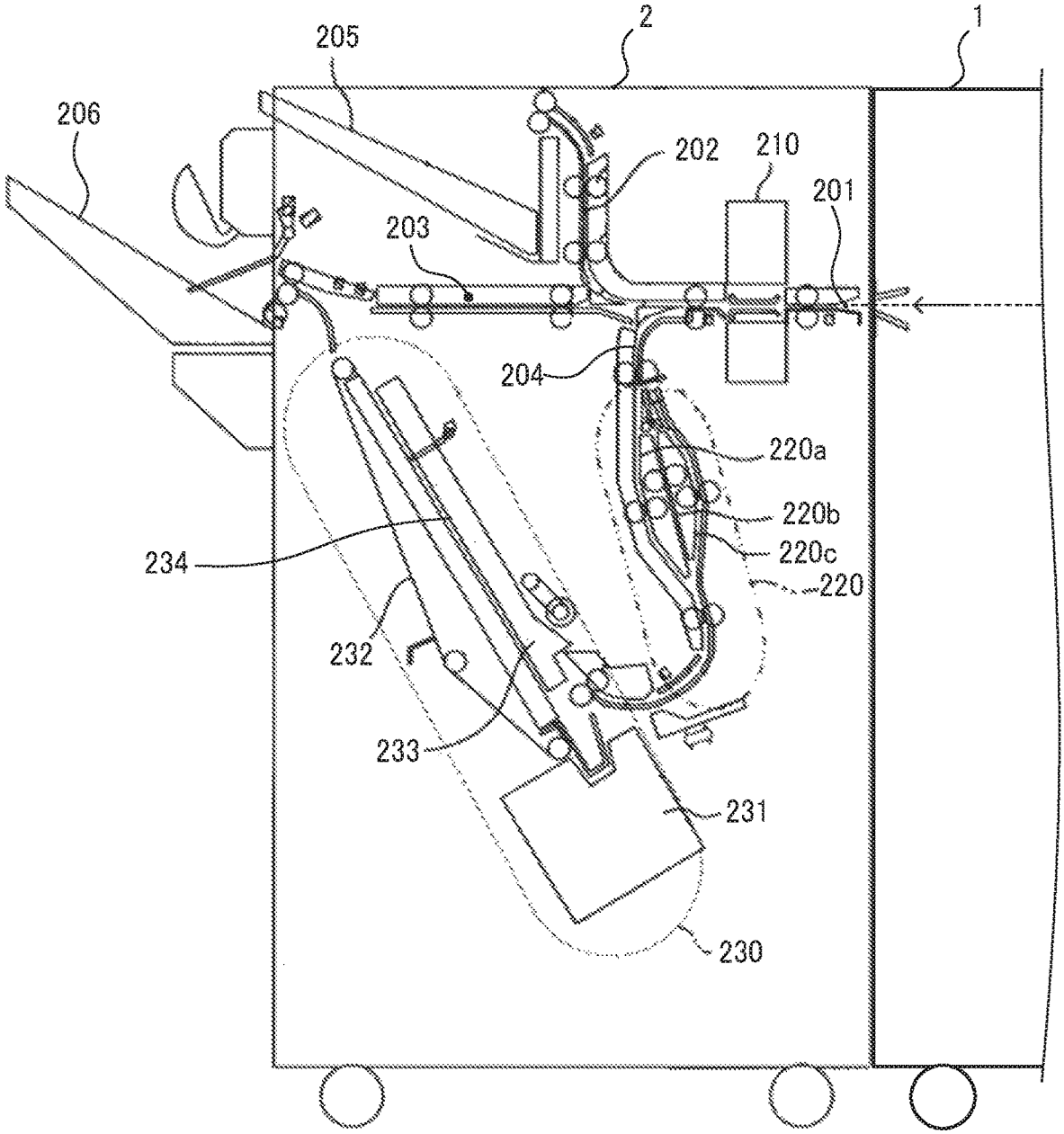
FIG. 3 is a schematic configuration diagram of a post-processing apparatus provided in the image forming system of FIG. 1.

FIG. 3 is a schematic configuration diagram of the post-processing apparatus 2 provided in the image forming system 4 according to the embodiment.

The post-processing apparatus 2 includes an introduction path 201 to receive the sheet from the folding processing apparatus 1 and three paths diverging from the introduction path 201, that is, a first ejection path 202 to eject the sheet to an upper tray 205, a second ejection path 203 to eject the sheet to a shift tray 206, and a conveyance path 204 to convey the sheet to a sheet binding device 230. On the introduction path 201, a punching device 210 is disposed to puncture a punch hole in the sheet. The punching device 210 punctures the punch hole at a predetermined position in a folded sheet, a folded sheet bundle, and a single sheet that has been conveyed without being folded, which are ejected from the folding processing apparatus 1.

On the conveyance path 204, an overlay device 220 is disposed. The overlay device 220 includes three conveyance paths 220*a*, 220*b*, and 220*c*. Sorting the sheets to each conveyance path and temporarily waiting on each conveyance path allows up to three sheets to be overlaid and conveyed.

The sheet binding device 230 includes a processing tray 233, a jogger fence 234 to align a plurality of sheets (that is a sheet bundle) in the processing tray 233, a stapler unit 231 to perform binding processing on the sheet bundle in the processing tray 233, and a conveyance belt 232 to convey the sheet bundle subjected to binding processing toward the shift tray 206.

When the predetermined number of sheets which are folded or not folded is conveyed to the processing tray 233, the jogger fence 234 performs the alignment processing on the sheet bundle in the processing tray 233. Then, after the stapler unit 231 performs the binding processing on the sheet bundle in the processing tray 233, the conveyance belt 232 conveys the bound sheet bundle, and the bound sheet bundle is ejected to the shift tray 206.

Figure 4:
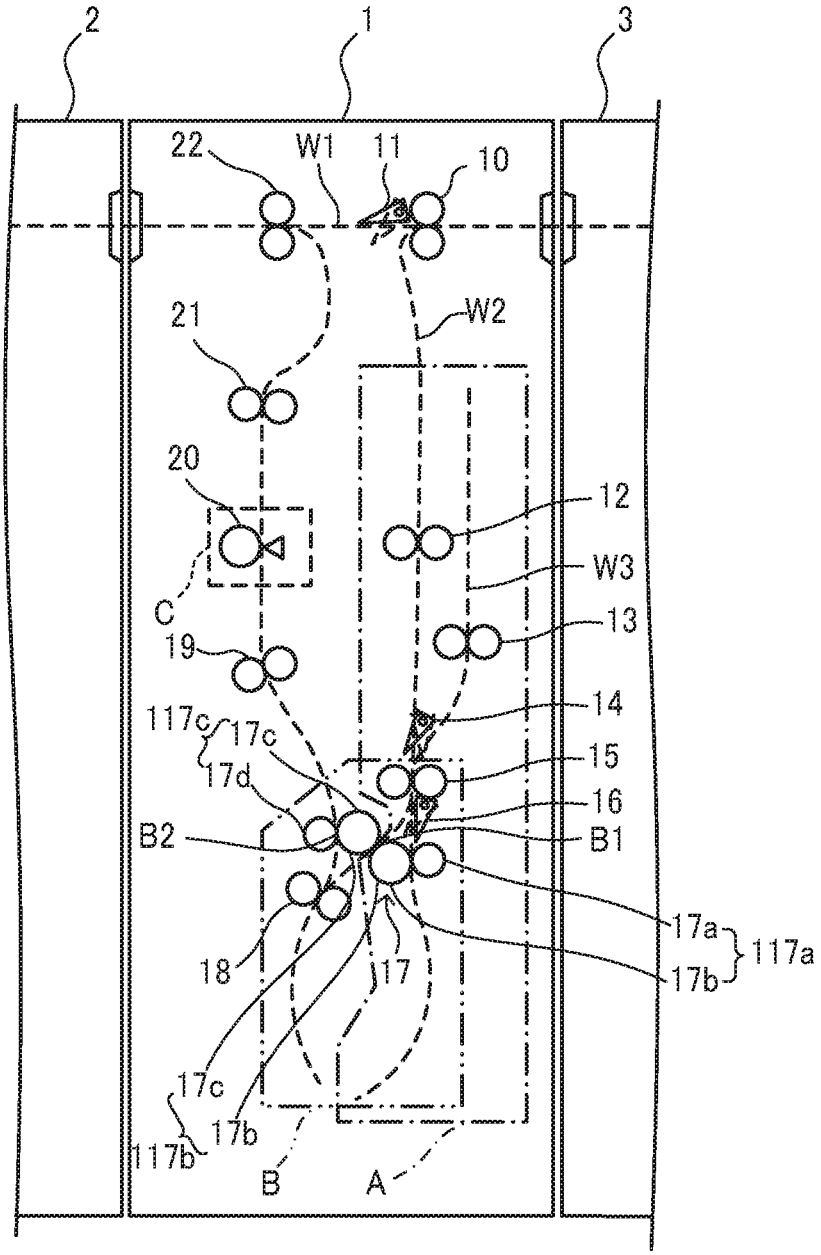
FIG. 4 is a schematic configuration diagram of a folding processing apparatus provided in the image forming system of FIG. 1.

FIG. 4 is a schematic configuration diagram of the folding processing apparatus 1 provided in the image forming system 4 according to the embodiment.

As illustrated in FIG. 4, the folding processing apparatus 1 includes an entry roller pair 10 to convey the sheet received from the image forming apparatus 3. On the downstream side from the entry roller pair 10, the sheet conveyance path is divided into a folding processing conveyance path W2 to convey the sheet and perform the folding processing and a through conveyance path W1 to convey the sheet without the folding processing. A first bifurcating claw 11 is disposed at a fork between the folding processing conveyance path W2 and the through conveyance path W1. The first bifurcating claw 11 guides the sheet to the through conveyance path W1 or the folding processing conveyance path W2.

The folding processing conveyance path W2 includes an overlay section A to overlay a plurality of sheets, a folding section B to fold one sheet or sheets overlaid in the overlay section A, and an additional folding section C in which the folded sheet is additionally folded.

The overlay section A includes a pair of registration rollers 15, a first conveyance roller pair 117*a* including a first pressing roller 17*a* in a folding mechanism 17 described later and a first folding roller 17*b*, and a conveyance roller pair 12 to convey the sheet toward the pair of registration rollers 15. The overlay section A also includes a switchback conveyance path W3 that branches from the folding processing conveyance path W2 between the conveyance roller pair 12 and the pair of registration rollers 15 and conveys the sheet conveyed in a reverse direction (conveyed in a direction opposite to the predetermined direction) by the pair of registration rollers 15, and a switchback conveying roller pair 13 disposed on the switchback conveyance path W3. The overlay section A also includes a second bifurcating claw 14 disposed at a fork between the switchback conveyance path W3 and the folding processing conveyance path W2 from the conveyance roller pair 12 to the pair of registration rollers 15 to guide the sheet conveyed in the reverse direction (conveyed in the direction opposite to the predetermined direction) toward the switchback conveyance path W3.

The folding section B is disposed downstream of the overlay section A. The folding section B includes the pair of registration rollers 15, the folding mechanism 17, and a second conveyance roller pair 18. The folding mechanism 17 includes the first folding roller 17*b*, the first pressing roller 17*a* which contacts the first folding roller 17*b* to switch back the sheet, a second folding roller 17*c* which contacts the first folding roller 17*b* to form a first folding nip B1, and a second pressing roller 17*d* which contacts the second folding roller 17*c* to form a second folding nip B2. The driving force is transmitted to one of the plurality of rollers included in the folding mechanism 17, and the other rollers are driven to rotate.

A third bifurcating claw 16 is disposed downstream of the pair of registration rollers 15 to guide the sheet to the nip between the first folding roller 17*b* and the first pressing roller 17*a* or the first folding nip B1.

On the downstream side of the folding section B, the additional folding section C is disposed. The additional folding section C includes an additional folding roller 20. The additional folding roller 20 has a pressing convex portion which presses the folded portion of the sheet and additionally folds the folded portion of the sheet.

Figure 5:
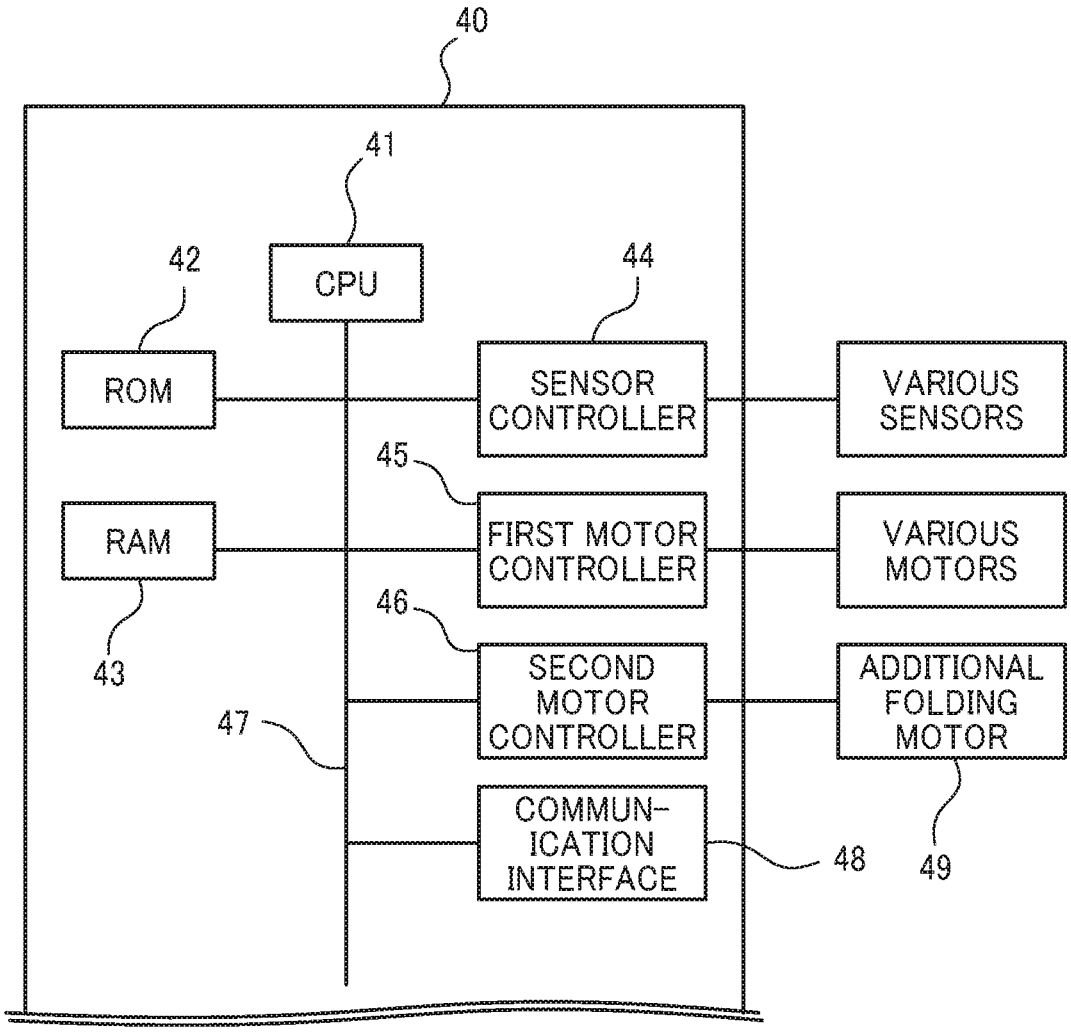
FIG. 5 is a block diagram of an example of a control circuit to control the folding processing apparatus of the image forming system of FIG. 1.

FIG. 5 is a block diagram of an example of a control circuit to control the folding processing apparatus 1 in the image forming system 4.

The controller 40 to control the folding processing apparatus 1 includes a Central Processing Unit (CPU) 41, a Read Only Memory (ROM) 42, a Random Access Memory (RAM) 43, a sensor controller 44 to control various sensors such as a paper detection sensor disposed in the folding processing apparatus 1, a first motor controller 45 to control a plurality of conveyance motors which convey the sheet in the folding processing apparatus 1, a second motor controller 46 to control the additional folding motor 49 drives the additional folding roller 20, and a communication interface 48.

These components are mutually electrically coupled via a bus line 47 such as an address bus or a data bus. The communication interface 48 communicates with the image forming apparatus 3 and the post-processing apparatus 2 in FIG. 1 and exchanges data necessary for control. The ROM 42 stores data and programs executed by the CPU 41. The CPU 41 executes a computer readable program stored in the ROM 42 to control the folding processing apparatus 1. The RAM 43 temporarily stores data when the CPU 41 executes the program.

FIGS. 6A to 6F are explanatory diagrams illustrating the sheet overlay operation executed by the overlay device A of the folding processing apparatus 1.

Figure 6A:
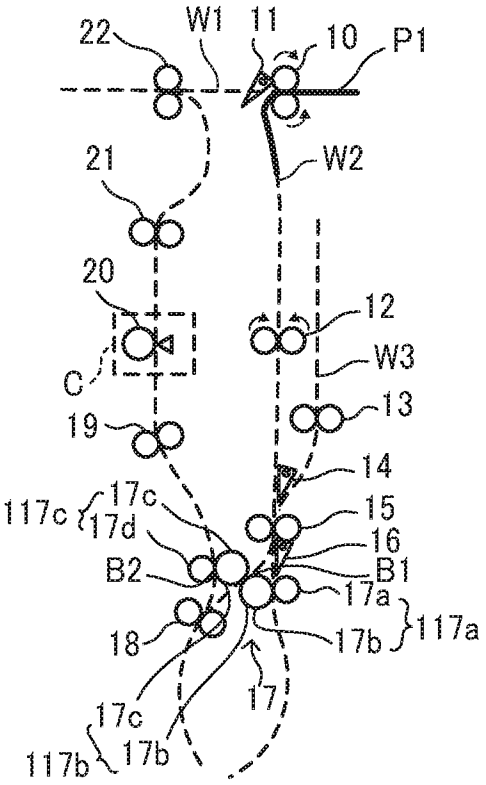
FIGS. 6A to 6F are explanatory diagrams illustrating a sheet overlay operation executed by an overlay device of the folding processing apparatus.

As illustrated in FIG. 6A, the entry roller pair 10 conveys the first sheet P1 to the folding processing conveyance path W2. The leading edge of the first sheet P1 conveyed to the folding processing conveyance path W2 contacts the pair of registration rollers 15 to correct the skew of the preceding sheet as necessary.

Figure 6B:
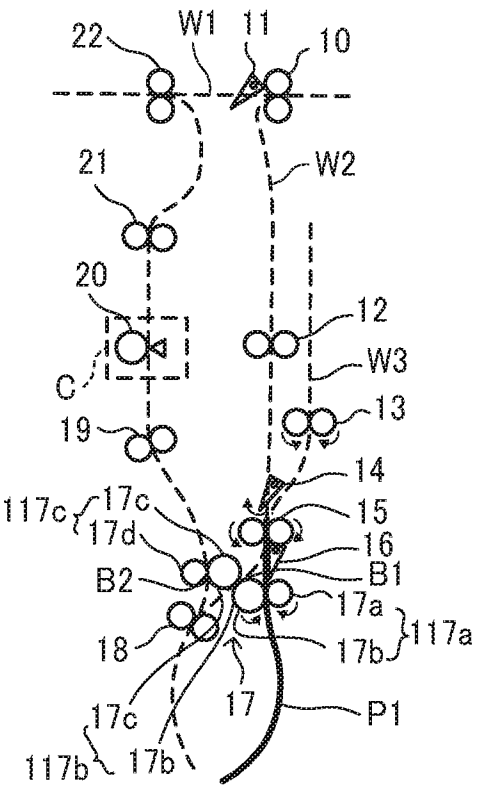
Figure 6C:
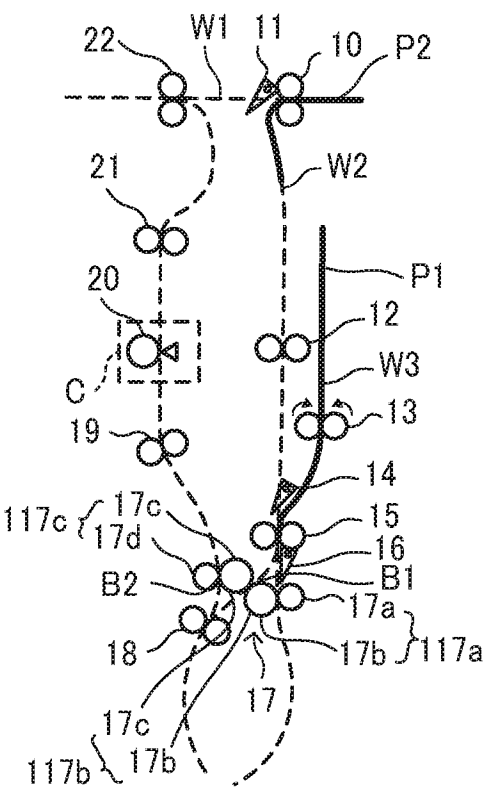

Next, the pair of registration rollers 15 and the first conveyance roller pair 117*a* serving as a first conveyance member including the first pressing roller 17*a* and the first folding roller 17*b* conveys the first sheet P1 in a predetermined direction which is called a regular direction. Next, when the trailing edge of the first sheet P1 passes through the fork between the folding processing conveyance path W2 and the switchback conveyance path W3, the conveyance of the first sheet P1 is stopped. Next, the second bifurcating claw 14 pivots in the clockwise direction in FIG. 6B, and the posture of the second bifurcating claw 14 is switched to guide the sheet P1 to the switchback conveyance path W3. Next, as illustrated in FIG. 6B, the pair of registration rollers 15, the first conveyance roller pair 117*a*, and the switchback conveying roller pair 13 rotate in reverse. This reverse rotation conveys the first sheet P1 in a reverse direction that is a direction opposite to the predetermined direction, and the first sheet P1 is conveyed to the switchback conveyance path W3. When the leading edge of the first sheet P1 in the regular direction is conveyed to the switchback conveyance path W3, the switchback conveying roller pair 13 stops the conveyance of the first sheet P1. After stopping the conveyance of the first sheet P1, as illustrated in FIG. 6C, the switchback conveying roller pair 13 conveys the first sheet P1 in the regular direction, strikes the leading edge of the first sheet P1 against the pair of registration rollers 15 to correct the skew, and puts the first sheet P1 on standby.

In this way, by conveying the preceding sheet P1 to the switchback conveyance path W3 and withdrawing the preceding sheet P1 from the folding processing conveyance path W2, the preceding sheet P1 does not obstruct the conveyance of a succeeding second sheet P2, thereby enabling smooth conveyance of the second sheet P2.

Figure 6D:
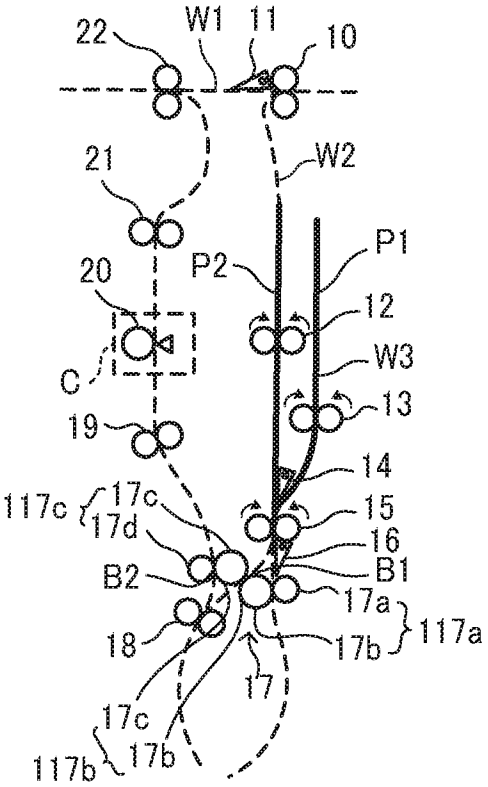
Figure 6E:
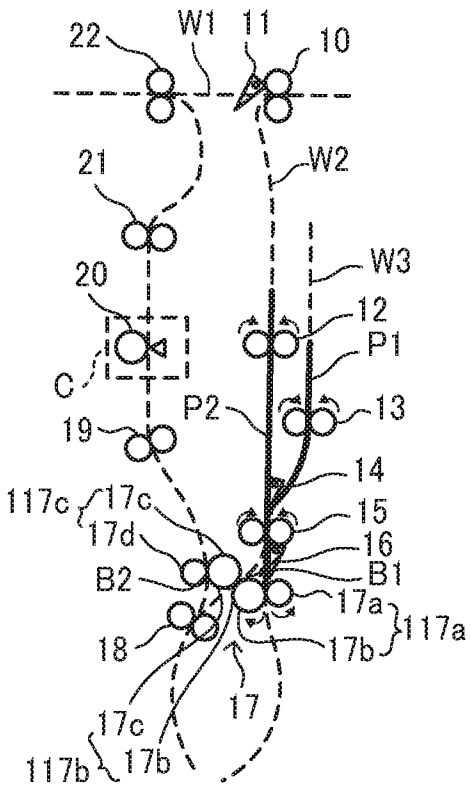
Figure 6F:
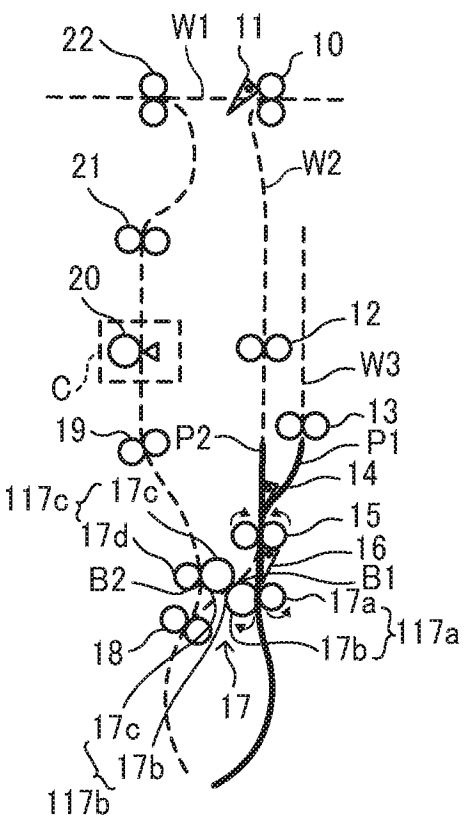

Next, the leading edge of the second sheet P2 contacts the pair of registration rollers 15. As illustrated in FIG. 6D, even after the leading edge of the second sheet P2 contacts the pair of registration rollers 15, the conveyance roller pair 12 continues to convey the second sheet P2 and bends the second sheet P2 to correct the skew of the second sheet P2. As illustrated in FIG. 6E, after a predetermined time in which the second sheet is bent by a predetermined amount has passed, the pair of registration rollers 15, the switchback conveying roller pair 13, and the first conveyance roller pair 117*a* rotate. As illustrated in FIG. 6F, the pair of registration rollers 15 conveys the first sheet P1 and the second sheet P2 in an overlaid manner.

When the number of overlaid sheets reaches the number set by the user, the folding device B starts the folding processing. On the other hand, when the number of overlaid sheets does not reach a number set by the user, the overlaid sheets are conveyed in the reverse direction when the trailing edge of the overlaid sheets has passed through the second bifurcating claw 14 and evacuates to the switchback conveyance path W3. The sheets P are overlaid by repeating the above-described operation according to the number of sheets to be overlaid.

In the present embodiment, as described above, the skew of the second sheet P2 is corrected without stopping the rotation of the conveyance roller pair 12, and the pair of registration rollers 15 starts to rotate when the bending of the second sheet P2 reaches the predetermined amount. Such a configuration allows the preceding sheet P1 to be overlaid on the succeeding second sheet P2 without affecting productivity.

While the number of the overlaid sheets does not reach the number set by the user, an overlay process without the skew correction by the pair of registration rollers 15 may be performed, and, when the number of the overlaid sheets reaches the number set by the user, the overlay process with the skew correction by the pair of registration rollers 15 may be performed. In the overlay process with the skew correction, the switchback conveying roller pair 13 strikes the leading edge of the preceding sheet P1 or a preceding sheet bundle against the pair of registration rollers 15 to correct the skew and puts the sheet P1 or the preceding sheet bundle on standby, and, after the conveyance roller pair 12 strikes the leading edge of the second sheet P2 against the pair of registration rollers 15 to correct the skew, the pair of registration rollers 15 conveys the overlaid sheets. On the other hand, in the overlay process without the skew correction, the leading edge of the preceding sheet P1 or the sheet bundle is placed in the switchback conveyance path W3 and put on standby. Then, the switchback conveying roller pair 13 starts to convey the preceding sheet P1 or the preceding sheet bundle so that the preceding sheet P1 or the preceding sheet bundle placed on the switchback conveyance path W3 reaches the pair of registration rollers 15 when the following sheet P2 reaches the pair of registration rollers 15, and the sheets are overlaid. The pair of registration rollers 15 conveys the overlaid sheets.

FIGS. 7A to 7D are explanatory diagrams illustrating the general operation when the folding device B performs the Z-folding processing.

The leading edge of the sheet bundle Pt conveyed by the pair of registration rollers 15 after the overlay process enters the first conveyance roller pair 117*a* including the first folding roller 17*b* and the first pressing roller 17*a*. Next, when the sheet bundle Pt is conveyed by a predetermined conveyance amount A1, a drive motor to drive the folding mechanism 17 reversely rotates. A travel distance at this time is appropriately determined depending on the length of the sheet bundle Pt in the sheet conveyance direction and the content of the folding processing, such as the manner of folding.

Figure 7A:
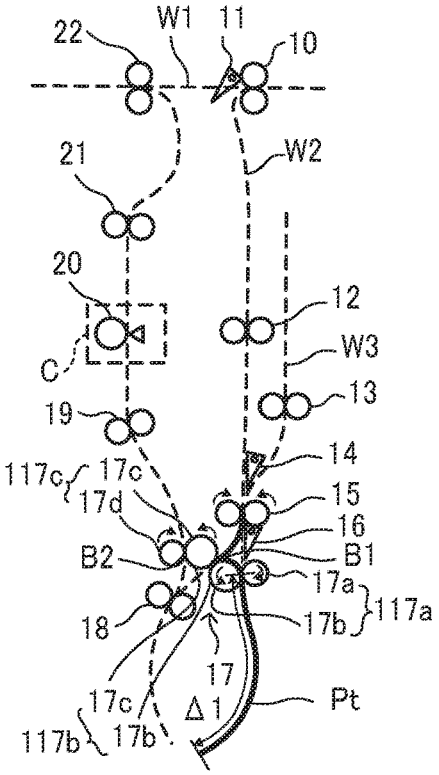
FIGS. 7A to 7D are explanatory diagrams illustrating a general operation when a folding device performs Z-folding processing.

Reverse rotation of the drive motor to drive the folding mechanism 17 conveys the sheet bundle Pt sandwiched by the first conveyance roller pair 117*a* in the reverse direction, that is, the direction opposite to the predetermined direction. This forms a bend in the sheet bundle portion between the pair of registration rollers 15 and the first conveyance roller pair 117*a* as illustrated in FIG. 7A. This bent portion, which is also called a folded-back portion, enters a nip between a first folding roller pair 117*b* including the first folding roller 17*b* and the second folding roller 17*c*, which forms the first folded portion in the folded-back portion. The first folded portion passing through the nip of the first folding roller 17*b* is conveyed toward the second conveyance roller pair 18 serving as a second conveyance member.

The first folded portion in the sheet bundle Pt enters the nip between the second conveyance roller pair 18, and when the sheet bundle Pt is conveyed by the predetermined conveyance amount A2, the second conveyance roller pair 18 reversely rotates and conveys the sheet bundle Pt sandwiched by the second conveyance roller pair 18 in the reverse direction that is the direction opposite to the predetermined direction. The conveyance amount A2 is appropriately determined depending on the length of the sheet bundle Pt in the sheet conveyance direction and a content of the folding processing such as folding manner.

Figure 7B:
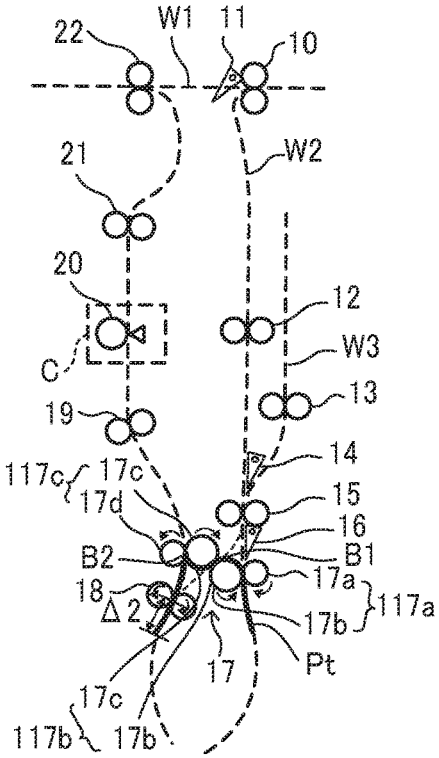

The conveyance of the sheet bundle Pt sandwiched by the second conveyance roller pair 18 in the reverse direction forms a bend in the sheet bundle between the first folding roller pair 117*b* and the second conveyance roller pair 18. As illustrated in FIG. 7B, this bent portion, which is also called a folded-back portion, enters a nip between a second folding roller pair 117*c* including the second folding roller 17*c* and the second pressing roller 17*d*, which forms the second folded portion in the folded-back portion.

Figure 7C:
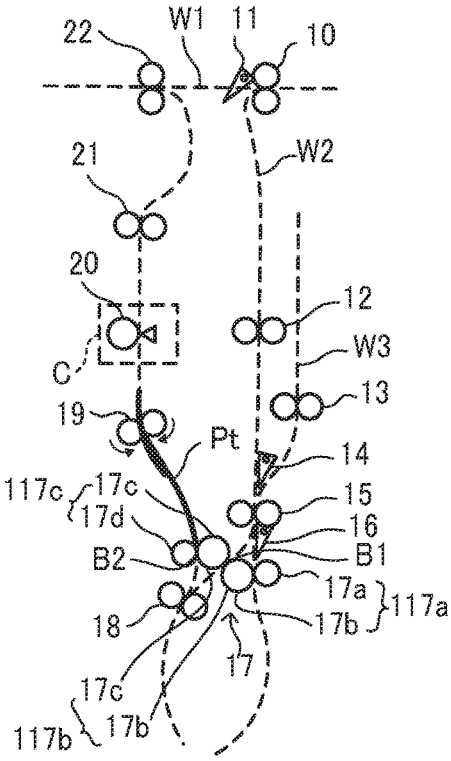
Figure 7D:
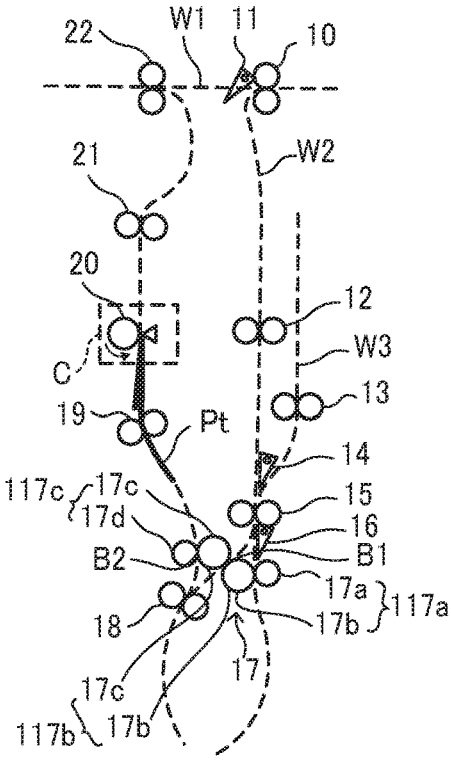

As illustrated in FIG. 7C, an intermediate conveyance roller pair 19 conveys the sheet bundle Pt including the two-folded portion formed as described above and having passed through the nip of the second folding roller pair 117*c* toward the additional folding roller 20. As illustrated in FIG. 7D, when the second folded portion reaches the position opposed to the additional folding roller 20, the conveyance of the sheet bundle Pt is stopped. Next, the additional folding roller 20 rotates to put a sharp crease at the second folded portion, and the conveyance of the sheet bundle Pt is resumed. When the first folding portion reaches the position opposed to the additional folding roller 20, the conveyance of the sheet bundle Pt is stopped. The additional folding roller 20 rotates to put a sharp crease at the first folded portion, and the conveyance of the sheet bundle Pt is resumed. Two conveyance roller pairs 21 and 22 convey the sheet bundle Pt, and the conveyance roller pair 22 ejects the sheet bundle Pt to the post-processing apparatus 2.

In the above description, the sheet bundle Pt after the overlay process is folded. The folding processing operation to fold one sheet is the same. In the above description, Z folding-processing is described. The same operation as the Z-folding processing in which the conveyance amount A1 and the conveyance amount A2 are appropriately changed enables to carry out the inner three-fold and the outer three-fold. In double folding processing, the third bifurcating claw 16 pivots in the clockwise direction in FIGS. 7A to 7D to adopt a posture for guiding the sheet to the first folding roller pair 117*b*, and the sheet conveyed from the pair of registration rollers 15 is conveyed to the first folding roller pair 117*b*. Then, the same operation as the above-described operation to form the second folded portion forms the folded portion at the center of the sheet in the conveyance direction, which enables double folding.

Next, a description is given of the detailed configuration of the sheet processing apparatus according to the present embodiment.

As described above, when the switchback conveying roller pair 13 strikes the leading edge of the first sheet P (hereinafter referred to as the preceding sheet P1) which is conveyed into the switchback conveyance path W3 on the pair of registration rollers 15 to correct the skew, the preceding sheet P1 may bend toward the folding processing conveyance path W2 that is an entrance path of the second sheet P2 (hereinafter referred to as the following sheet P2) and close the folding process conveyance path W2. When the preceding sheet P1 closes the folding process conveyance path W2, as a result, the preceding sheet P1 obstructs entry of the following sheet P2 to the pair of registration rollers 15, resulting in conveyance failure.

Therefore, in the present embodiment, the preceding sheet P1 is bent to the opposite side to the folding processing conveyance path W2 and waits for the following sheet P2. A description of the detailed configurations is given below with reference to drawings.

Figure 8:
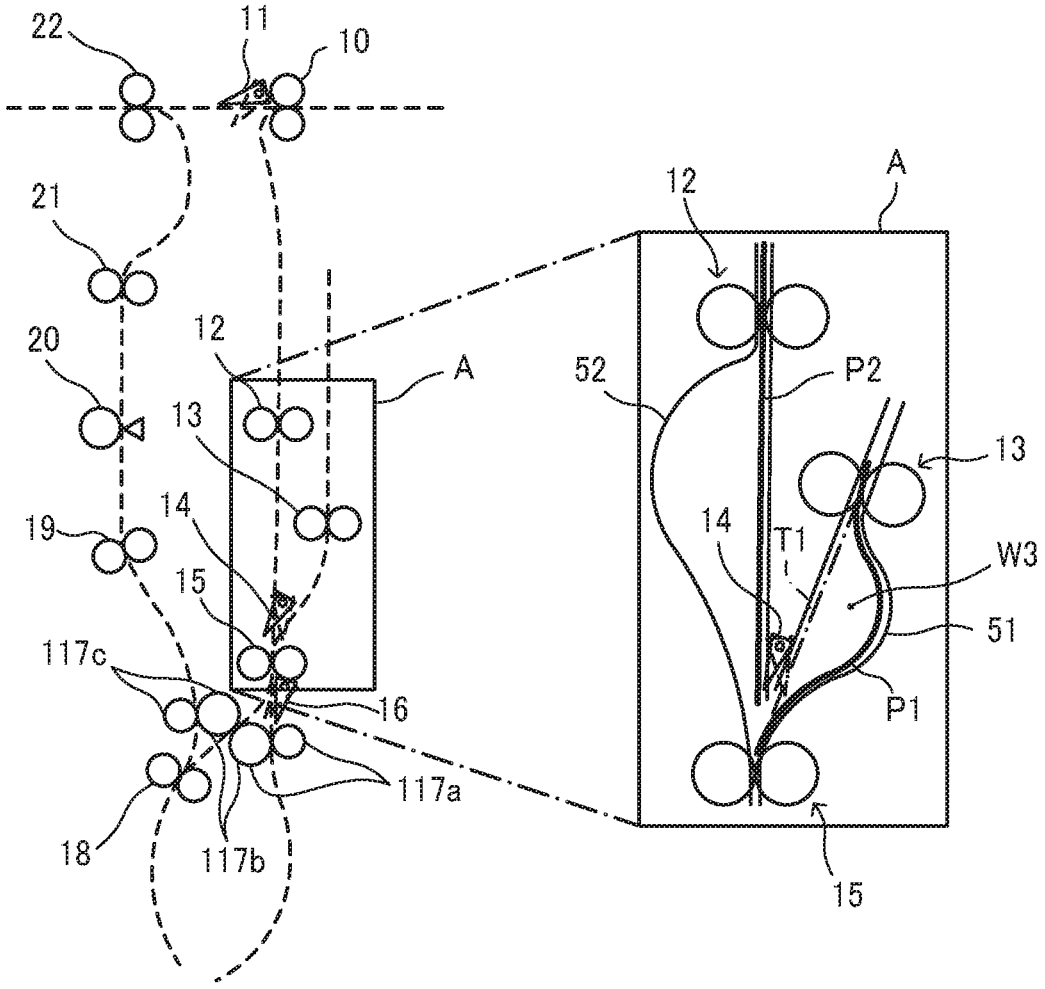
FIG. 8 is an enlarged diagram illustrating a configuration of an overlay device in the image forming system of FIG. 1.

FIG. 8 is an enlarged diagram illustrating a configuration of an overlay device A according to the present embodiment.

As illustrated in FIG. 8, there is a space 51 in the switchback conveyance path W3 to bend the preceding sheet on the side opposite to the folding processing conveyance path W2 with respect to a line segment T1 that connects a nip between the switchback conveying roller pair 13 serving as a nip in the preceding sheet conveyer and a nip between the pair of registration rollers 15 serving as a nip in the registration conveyer. The space 51 to bend the preceding sheet is wider than a space on the side of the folding processing conveyance path W2. Specifically, to create the space 51 to bend the preceding sheet on the side opposite to the folding processing conveyance path W2, a guide on the side opposite to the folding processing conveyance path W2 among a pair of guides in the switchback conveyance path W3 is bent to the side opposite to the folding processing conveyance path W2.

Additionally, there is a space 52 to bend the following sheet between the conveyance roller pair 12 and the pair of registration rollers 15 on the folding processing conveyance path W2. In the present embodiment, the space 52 to bend the following sheet is provided on the side opposite to the switchback conveyance path W3, but the space 52 to bend the following sheet may be provided on the side of the switchback conveyance path W3.

The above-described space 51 to bend the preceding sheet and the above-described space 52 to bend the following sheet are wider than a space where the sheet bends more than the maximum skew amount that occurs until the leading edge of the sheet contacts the pair of registration rollers 15. In a skew correction control of the preceding sheet P1 and a skew correction control of the following sheet P2, the sheet is controlled to bend more than the maximum skew amount. Specifically, in the skew correction control of the preceding sheet P1, the first motor controller 45 controls conveyance by the switchback conveying roller pair 13 so that a sheet conveyance amount conveyed by the switchback conveying roller pair 13 after the leading edge of the preceding sheet P1 contacts the pair of the registration rollers 15 becomes more than the maximum skew amount. On the other hand, in the skew correction control of the following sheet P2, the first motor controller 45 controls conveyance by the pair of the registration rollers 15 to start the conveyance by the pair of the registration rollers 15 when the conveyance amount of the conveyance roller pair 12 becomes equal to or larger than the maximum skew amount after the leading edge of the following sheet P2 contacts the pair of registration rollers 15.

In the present embodiment, the space 52 to bend the following sheet is wider than the space 51 to bend the preceding sheet because of the following reason. After the leading edge of the preceding sheet P1 contacts the pair of the registration rollers 15 to correct the skew, the preceding sheet P1 is conveyed to the switchback conveyance path W3 by the above-described control in which the first motor controller 45 controls the conveyance of the preceding sheet P1 so that the preceding sheet P1 is conveyed in the reverse direction after the preceding sheet is conveyed in the regular direction until the trailing edge of the preceding sheet P1 pass through the fork between the switchback conveyance path W3 and the folding processing conveyance path W2. While the preceding sheet P1 is sandwiched by the pair of the registration rollers 15, there is almost no skew in the preceding sheet P1. The skew of the preceding sheet P1 may occur just in the switchback conveyance path W3 while the preceding sheet P1 is conveyed into the switchback conveyance path W3 after the leading edge of the preceding sheet P1 in the regular direction pass through the pair of the registration rollers 15. On the other hand, the skew of the following sheet P2 is not corrected until the leading edge of the following sheet P2 reaches the pair of the registration rollers 15 after the following sheet P2 is ejected from the image forming apparatus 3. Therefore, a skew amount of the following sheet P2 is likely to be greater than a skew amount of the preceding sheet P1.

In addition, in the skew correction control of the following sheet P2, the conveyance roller pair 12 continues to convey the following sheet P2 even after the leading edge of the following sheet P2 contacts the pair of the registration rollers 15, and, subsequently, after a predetermined time has passed, the pair of the registration rollers 15 starts to rotate and convey the following sheet P2. A predetermined time is required until the pair of the registration rollers 15 rotates at the same speed as the rotation speed of the conveyance roller pair 12 after the pair of the registration rollers 15 starts to rotate. The following sheet P2 continues to bend during this predetermined time.

For these reasons, the space 52 to bend the following sheet P2 is wider than the space 51 to bend the preceding sheet P1.

In the present embodiment, since the space 51 to bend the preceding sheet P1 is provided on the side opposite to the folding processing conveyance path W2 in the switchback conveyance path W3, the preceding sheet P1 can be folded in the space 51 to bend the preceding sheet P1 on the side opposite to the folding processing path W2 when the skew of the preceding sheet P1 is corrected. This makes it possible to prevent the preceding sheet P1 after the skew correction from closing the folding processing conveyance path W2 and smoothly convey the following sheet P2 to the pair of registration rollers 15, which avoids the occurrence of the conveyance trouble of the following sheet.

Further, in the present embodiment, skew correction of the preceding sheet P1 and the following sheet P2 by the pair of registration rollers 15 decreases the misalignment between the preceding sheet P1 and the following sheet P2.

Next, a description is given of variations of the present embodiment described above.

First Variation

Figure 9:
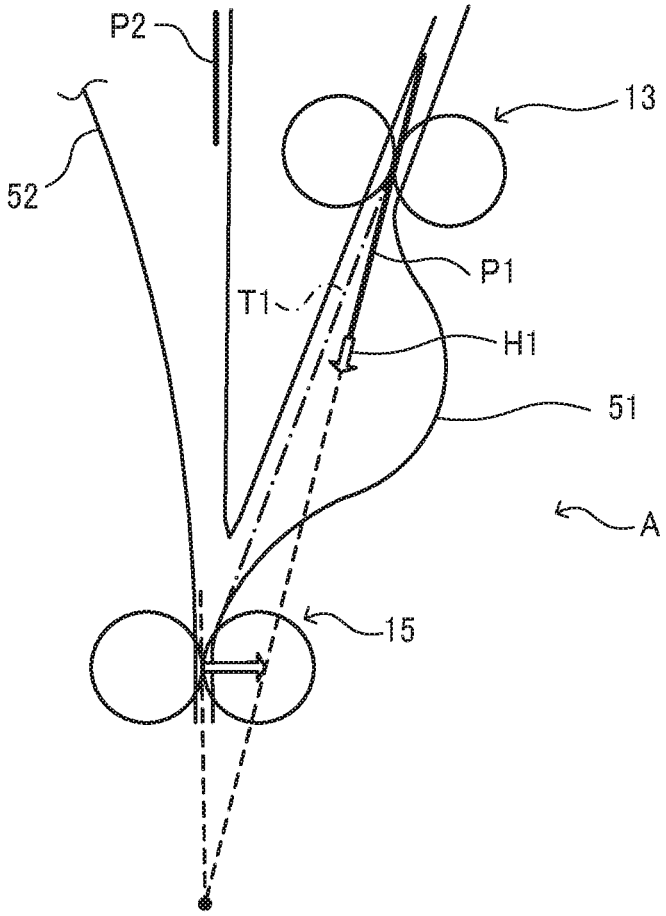
FIG. 9 is an enlarged diagram illustrating a configuration of an overlay device according to a first variation.

FIG. 9 is an enlarged diagram illustrating a configuration of an overlay device A according to a first variation.

The overlay device A according to the first variation is configured for the switchback conveying roller pair 13 to convey the preceding sheet P1 on the side opposite to the folding processing conveyance path W2 with respect to the line segment T1 that connects the nip between the switchback conveying roller pair 13 and the nip between the pair of registration rollers 15.

In this configuration, after the leading edge of the preceding sheet P1 contacts the pair of registration rollers 15, the switchback conveying roller pair 13 send the preceding sheet P2 in a direction illustrated by an arrow HI in FIG. 9, that is, the direction toward the side opposite to the folding processing conveyance path W2 with respect to the line segment T1 that connects the nip between the switchback conveying roller pair 13 and the nip between the pair of registration rollers 15. This makes it easy for the preceding sheet P1 to bend between the switchback conveying roller pair 13 and the pair of registration rollers 15 toward the side opposite to the folding process conveyance path W2. Therefore, the preceding sheet P1 can more certainly bend on the side opposite to the folding processing conveyance path W2. This makes it possible to prevent the preceding sheet P1 from obstructing the entry of the following sheet P2 to the pair of registration rollers 15 and avoid the occurrence of the conveyance trouble of the following sheet.

Second Variation

Figure 10:
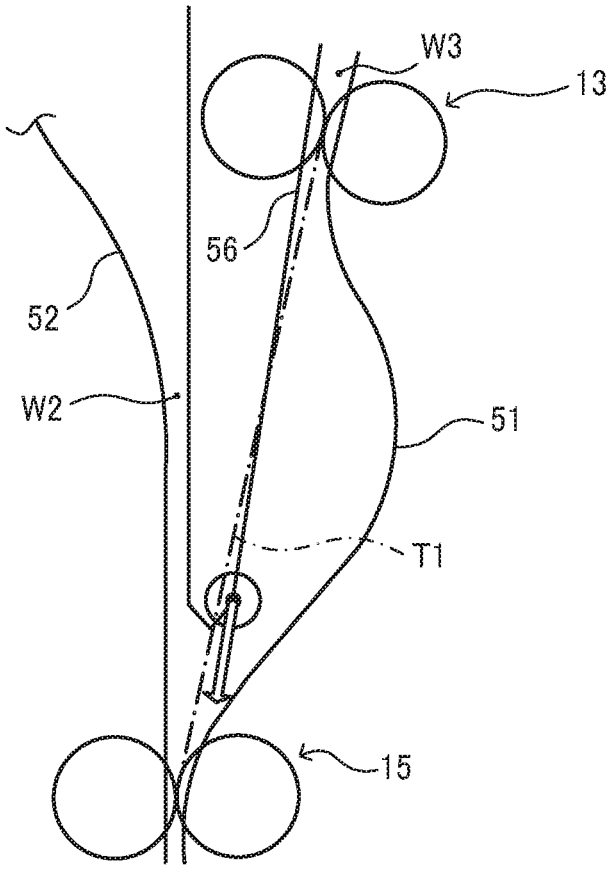
FIG. 10 is an enlarged diagram illustrating a configuration of an overlay device according to a second variation.

FIG. 10 is an enlarged diagram illustrating a configuration of an overlay device A according to a second variation.

As illustrated in FIG. 10, the overlay device A according to the second variation includes a guide 56 disposed on the side of the folding processing conveyance path W2 in the switchback conveyance path W3. A guide face of the guide 56 crosses the line segment T1 that connects the nip between the switchback conveying roller pair 13 and the nip between the pair of registration rollers 15. Specifically, the downstream side of the guide 56 on the side of the folding processing conveyance path W2 is positioned on the side of the folding processing conveyance path W2 with respect to the line segment T1 that connects the nip between the switchback conveying roller pair 13 and the nip between the pair of registration rollers 15.

This configuration makes it possible to prevent the leading portion of the preceding sheet P1 from bending toward the folding processing conveyance path W2 when the leading edge of the preceding sheet P1 contacts the pair of registration rollers 15. In this configuration, the leading edge of the preceding sheet P1 contacts the guide 56, and, while the leading portion of the preceding sheet P1 bends toward the side opposite to the folding processing conveyance path W2, the leading edge of the preceding sheet P1 contacts the pair of the registration rollers 15. This makes it easy for the preceding sheet P1 to bend toward the side opposite to the folding processing conveyance path W2. Therefore, the preceding sheet P1 can more certainly bend on the side opposite to the folding processing conveyance path W2. This makes it possible to prevent the preceding sheet P1 from obstructing the entry of the following sheet P2 to the pair of registration rollers 15 and avoid the occurrence of the conveyance trouble of the following sheet.

Third Variation

Figure 11:
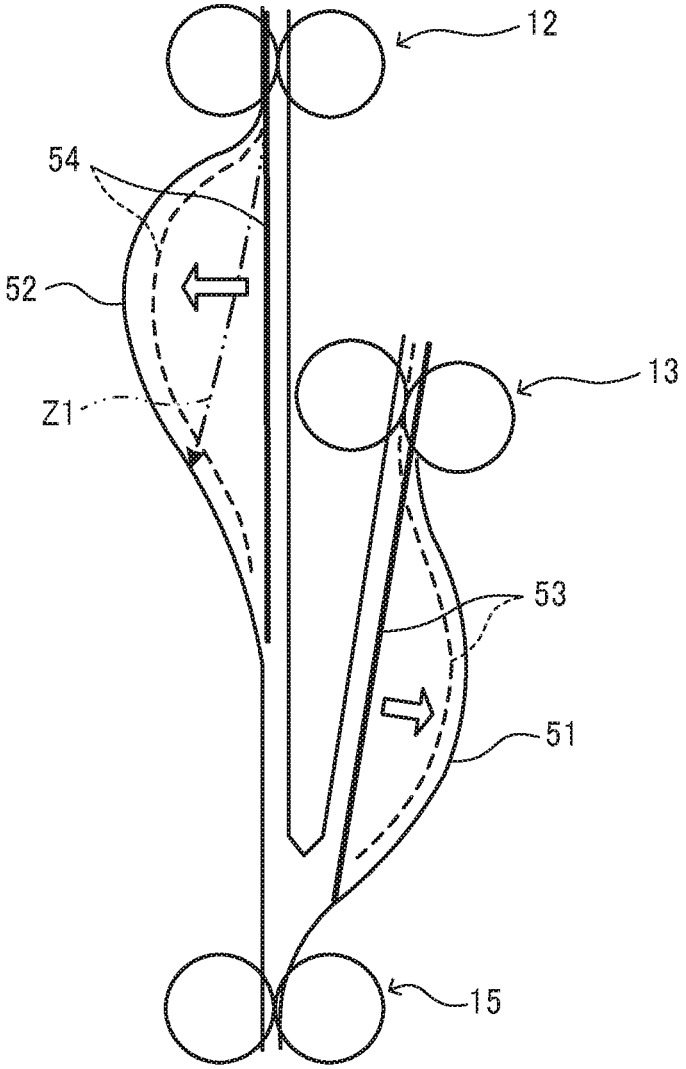
FIG. 11 is an enlarged diagram illustrating a configuration of an overlay device according to a third variation.

FIG. 11 is an enlarged diagram illustrating a configuration of an overlay device A according to a third variation.

The overlay device A according to the third variation includes elastic members 53 and 54 in the space 51 to bend the preceding sheet and the space 52 to bend the following sheet, respectively, to prevent the leading edge of the sheet from entering each of the spaces.

The leading edge of the sheet with curl toward the above-described space side enters the space as illustrated by a two-dot chain line arrow Z1 in FIG. 11, and the leading edge of the sheet strikes a guide that forms the space. If the leading edge of the sheet strikes the guide that forms the space, the sheet may bend, and conveyance failure may occur.

Therefore, in the third variation, elastic members 53 and 54 are provided in the space 51 to bend the preceding sheet and the space 52 to bend the following sheet, respectively. Each of the elastic members 53 and 54 is, for example, a film having a thickness of 0.1 to 0.2 mm, and when the sheet is bent and deformed, each of the elastic members 53 and 54 is elastically deformed to bend the sheet toward the space 51 and 52, respectively. Further, the upstream end portions of the elastic members 53 and 54 in the sheet conveyance direction are fixed by adhesion.

If the film-shaped elastic members 53 and 54 waves in a direction orthogonal to the sheet conveyance direction, when the sheet elastically deforms and deforms the elastic member, the sheet follows the waviness of the elastic member and may be deformed to be the waviness in the direction orthogonal to the sheet conveyance direction. Such waviness of the sheet in the direction orthogonal to the sheet conveyance direction may cause creases extending the sheet conveyance direction in the sheet during the folding process. Therefore, the elastic members are tightened in the direction orthogonal to the sheet conveyance direction and fixed.

As described above, setting the elastic members 53 and 54 prevents the occurrence of the conveyance failure because the elastic members 53 and 54 guide the leading edge of the sheet toward the pair of the registration rollers 15.

When the sheet bends to correct the skew, the elastic members 53 and 54 are elastically deformed to follow the bent sheet as illustrated by dotted lines in FIG. 11.

As a result, skew correction of the sheet can be smoothly performed, and overlay misalignment between the preceding sheet and the following sheet can be decreased.

Fourth Variation

Figure 12:
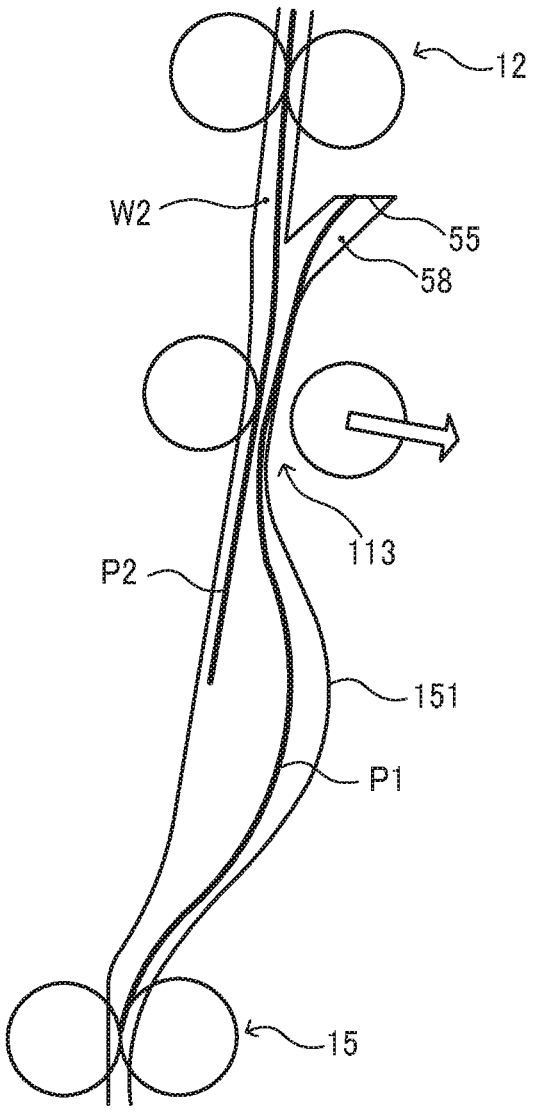
FIG. 12 is an enlarged diagram illustrating a configuration of an overlay device according to a fourth variation.

FIG. 12 is an enlarged diagram illustrating a configuration of an overlay device A according to a fourth variation.

The overlay device A according to the fourth variation does not include the switchback conveyance path W3, and the path through which the preceding sheet enters the pair of registration rollers 15 and the path through which the following sheet enters the pair of registration rollers 15 are the same.

In the fourth variation, a reverse conveyance roller pair 113 is disposed between the pair of registration rollers 15 and the conveyance roller pair 12. One roller of the reverse conveyance roller pair 113 is configured to be able to contact and separate from the other roller.

Between the conveyance roller pair 12 and the reverse conveyance roller pair 113, a shelter portion 58 branching off from the folding processing conveyance path W2 is disposed to enter the trailing end of the preceding sheet in the regular direction. The shelter portion has a contact portion 55, which the trailing end of the preceding sheet in the regular direction contacts. A pair of guides between the reverse conveyance roller pair 113 and the pair of registration rollers 15 has a guide that is curved outward on the side of the shelter portion 58, that is, the right side in FIG. 12, to form a common space 151 to bend the preceding sheet and the following sheet for the skew correction.

The sheet overlay process in the fourth variation is performed as follows. When the conveyance roller pair 12 conveys the preceding sheet P1, one roller of the reverse conveyance roller pair 113 is separated from the other roller. The conveyance roller pair 12 conveys the preceding sheet P1 in the regular direction from when the leading edge of the preceding sheet P1 contacts the pair of registration rollers 15 to correct the skew until the trailing edge of the preceding sheet P1 pass through the reverse conveyance roller pair 113. Next, after the one roller of the reverse conveyance roller pair 113 is brought into contact with the other roller, the reverse conveyance roller pair 113 and the pair of registration rollers 15 reversely rotate to convey the preceding sheet P1 in the reverse direction. When the trailing edge of the preceding sheet P1 in the regular direction enters the shelter portion 58 and contacts the contact portion 55, only driving of the reverse conveyance roller pair 113 is stopped. Since the pair of registration rollers 15 continues to convey the preceding sheet P1 in the reverse direction, the preceding sheet P1 bends between the reverse conveyance roller pair 113 and the pair of registration rollers 15. Since the preceding sheet P1 bends toward the common space 151, the preceding sheet P1 does not obstruct an entry of the following sheet P2 into the pair of registration rollers 15.

Preferably, the sheet conveyance direction by the pair of registration rollers 15 is set toward the common space 151 with respect to a line segment connecting a nip between the reverse conveyance roller pair 113 and the nip between the pair of registration rollers 15 because the preceding sheet P1 easily bends toward the common space 151 to bend the preceding sheet P1 and the following sheet P2.

After the leading edge of the preceding sheet P1 in the regular direction depart from the pair of registration rollers 15, the conveyance in the reverse direction by the pair of registration rollers 15 is stopped, and the one roller of the reverse conveyance roller pair 113 separates from the other roller. Separating one roller of the reverse conveyance roller pair 113 from the other roller releases the sandwiching of the sheet by the reverse conveyance roller pair 113, but the bend in the preceding sheet P1 is maintained as illustrated in FIG. 12 because the trailing edge of the preceding sheet P1 contacts the contact portion 55 in the shelter portion 58.

Next, the conveyance roller pair 12 conveys the following sheet P2 toward the pair of registration rollers 15. As illustrated in FIG. 12, the following sheet P2 is not obstructed by the preceding sheet P1 and smoothly contacts the pair of registration rollers 15 because the preceding sheet P1 bends not to obstruct the entry of the following sheet P1 to the pair of registration rollers 15. After the following sheet P2 contacts the pair of registration rollers 15, for a predetermined time, the pair of registration rollers 15 stops, and the conveyance roller pair 12 continues to convey the following sheet P2 to bend the following sheet P2. The following sheet P2 also bends toward the wide common space 151 to correct the skew of the following sheet P2. After the predetermined time has passed, the pair of registration rollers 15 rotates to convey the following sheet P2 overlaid on the preceding sheet P1 in the regular direction.

In the fourth variation, it is possible to reduce the size of the apparatus as compared with the apparatus provided with the switchback conveyance path W3.

Fifth Variation

Figure 13:
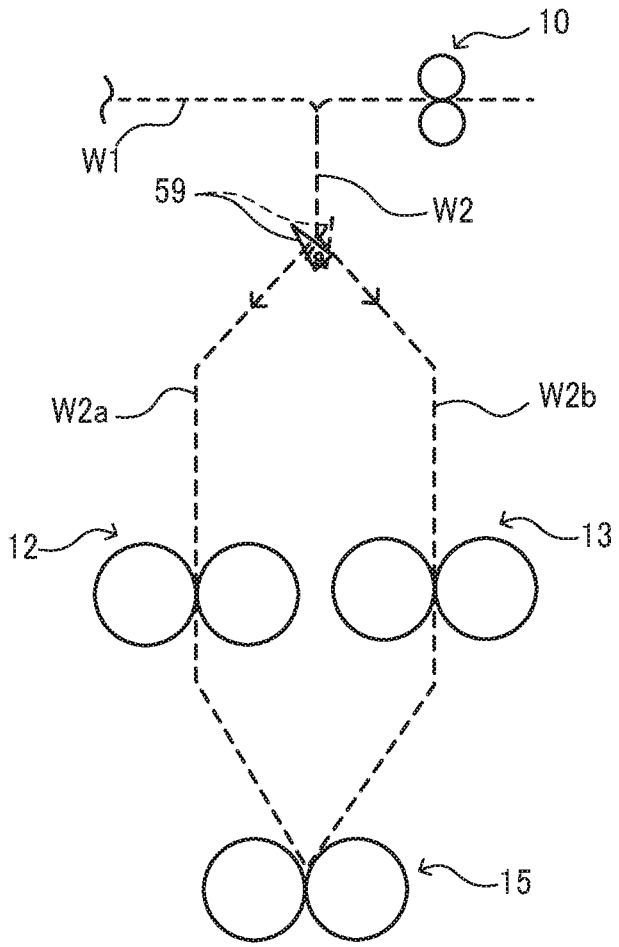
FIG. 13 is an enlarged diagram illustrating a configuration of an overlay device according to a fifth variation.

FIG. 13 is an enlarged diagram illustrating a configuration of an overlay device A according to a fifth variation.

The overlay device A according to the fifth variation includes a plurality of sheet conveyance paths from the fork between the folding processing conveyance path W2 and the through conveyance path W1 to the pair of registration rollers 15, that is, in this example, a first conveyance path W2*a* and a second conveyance path W2*b*.

As illustrated in FIG. 13, a bifurcating claw 59 is disposed at the fork between the first conveyance path W2*a* and the second conveyance path W2*b*.

When the two sheets are overlaid, the preceding sheet P1 is conveyed to the first conveyance path W2*a* and stands by with the leading edge contacting the pair of registration rollers 15. Next, the following sheet P2 is conveyed to the first conveyance path W2*a*. After the leading edge of the following sheet P2 contacts the pair of registration rollers 15, the pair of registration rollers 15 rotates to convey the following sheet P2 overlaid on the preceding sheet P1.

The overlay device A according to the fifth variation does not need a switchback conveying control. In the switchback conveying control, when the two sheets are overlaid, after the leading edge of the preceding sheet P1 contacts the pair of registration rollers 15, the preceding sheet P1 is conveyed in the regular direction until the trailing edge of the preceding sheet P1 pass through the switchback conveyance path W3 and, subsequently, conveyed in the reverse direction toward the switchback conveyance path W3. This can narrow the space between the preceding sheet P1 and the following sheet P2 and improve productivity.

When three or more sheets are overlaid, up to two sheets are conveyed in order of the first conveyance path W2*a* and the second conveyance path W2*b* from the image forming apparatus. After the two sheets are conveyed and overlaid, a bundle of the two sheets is conveyed to the second conveyance path W2*b* by the switchback conveying control and held until the following sheet is conveyed to the first conveyance path W2*a*.

In this example, there are two sheet conveyance paths from the fork between the folding processing conveyance path W2 and the through conveyance path W1 to the pair of registration rollers 15, but three or more sheet conveyance paths may be provided. When three or more conveyance paths are provided, although the apparatus is increased in size, productivity can be improved.

Sixth Variation

Figure 14:
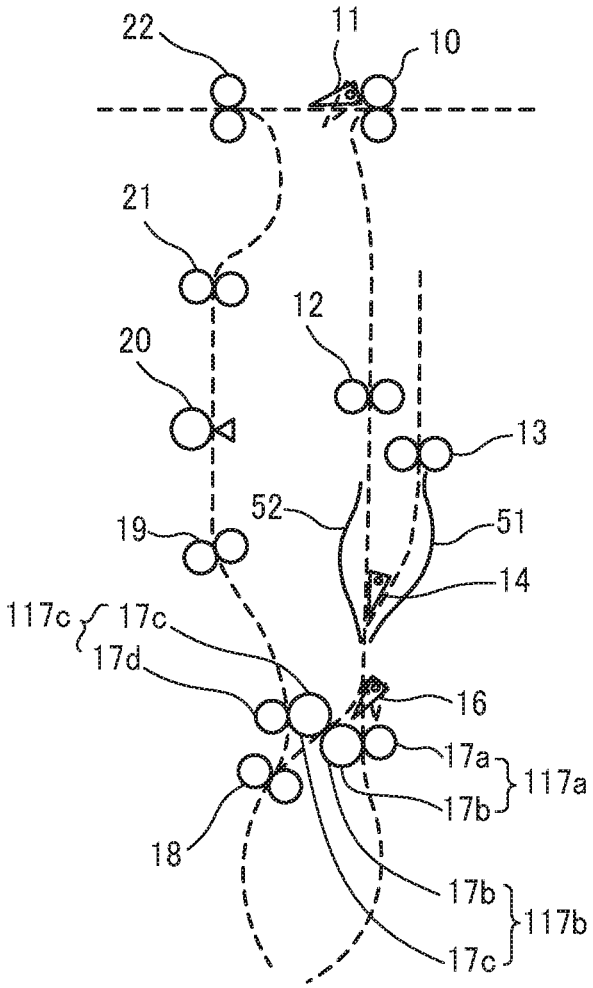
FIG. 14 is a schematic configuration diagram of a folding processing apparatus according to a sixth variation.

FIG. 14 is a schematic configuration diagram of a folding processing apparatus in a sixth variation.

The folding processing apparatus in the sixth variation use the first conveyance roller pair 117*a* including the first pressing roller 17*a* and the first folding roller 17*b* as the pair of registration rollers. Additionally, the space 51 to bend the preceding sheet P1 and the space 52 to bend the following sheet P2 are disposed on the upstream side of the third bifurcating claw 16.

In the overlay process, the preceding sheet P1 contacts the first conveyance roller pair 117*a* to correct the skew. After the skew is corrected, the first conveyance roller pair 117*a* conveys the preceding sheet P1 to the switchback conveyance path W3 in the same manner as described above. Subsequently, the leading edge of the preceding sheet P1 contacts the first conveyance roller pair 117*a* again and stands by. Next, the following sheet P2 contacts the first conveyance roller pair 117*a* to correct the skew. Next, the preceding sheet P1 and the following sheet P2 are overlaid, and the first conveyance roller pair 117*a* rotates in the regular direction and conveys the sheet bundle of the preceding sheet P1 and the following sheet P2 in the regular direction by a predetermined conveyance amount. During this conveyance in the regular direction, the bending of the preceding sheet P1 and the following sheet P2 is canceled. Specifically, the rotation speed of the first conveyance roller pair 117*a* that is a sheet conveyance speed moved by the first conveyance roller pair 117*a* is set to be higher than the rotation speed of the conveyance roller pair 12 and the switchback conveying roller pair 13 that is a sheet conveyance speed moved by the conveyance roller pair 12 and the switchback conveying roller pair 13, and this speed difference cancels the bending of the sheet bundle of the preceding sheet P1 and the following sheet P2 while the sheet bundle of the preceding sheet P1 and the following sheet P2 is conveyed by the predetermined conveyance amount.

After the sheet bundle is conveyed by the predetermined conveyance amount, with reference to FIG. 14, the third bifurcating claw 16 pivots from the position indicated by the dotted line to the position indicated by the solid line and pushes the folded-back portion of the sheet bundle toward the first folding roller pair 117*b*. At the same time, the first conveyance roller pair 117*a* rotates in the reverse direction to convey the sheet bundle in the reverse direction. This rotation bends the sheet bundle, and the bending portion of the sheet bundle enters the nip between the first folding roller pair 117*b*, which forms the first folded portion in the sheet bundle. After the first folded portion is formed, similarly to the above, the first folded portion is conveyed to the second conveyance roller pair 18. The second conveyance roller pair 18 conveys the sheet bundle in the regular direction by a predetermined conveyance amount and conveys in the reverse direction. This forms the bending portion in the sheet bundle between the first folding roller pair 117*b* and the second conveyance roller pair 18, and the bending portion that is the folded-back portion enters the nip between the second folding roller pair 117*c* to form the second folded portion.

In the present embodiment, the folding device B is disposed in the downstream of the overlay device A. However, a stapler that staples the sheet bundle or other devices may be disposed in the downstream of the overlay device A.

The above-described embodiments are only examples and, for example, in the following aspects of the present disclosure, advantages described below can be obtained.

First Aspect

The sheet processing apparatus according to the first aspect includes conveyers such as the conveyance roller pair 12, the switchback conveying roller pair 13, the second bifurcating claw 14, the pair of registration rollers 15, the third bifurcating claw 16, the guide 56, the first conveyance roller pair 117*a*, and the reverse conveyance roller pair 113 which convey a sheet. The conveyers include a registration conveyer such as the pair of registration rollers 15 and the first conveyance roller pair 117*a* which a plurality of sheets is to sequentially contact and are configured to bend a preceding sheet contacting the registration conveyer toward a direction in which the preceding sheet does not obstruct an entry of a following sheet to the registration conveyer when the conveyers overlay and convey the plurality of sheets after the plurality of sheets sequentially contacts the registration conveyer.

When the preceding sheet conveyed in a substantially loop shape curved path bends and contacts the registration conveyer such as a pair of skew correction rollers to correct the skew, the preceding sheet with the leading edge contacting the registration conveyer may bend and close an entry path to the pair of skew correction rollers and obstructs entry of the following sheet into the registration conveyer, which may result in conveyance failure.

On the other hand, in the first aspect, the preceding sheet bends to the side that does not prevent the following sheet from entering the registration conveyer and stands by. This reduces that the preceding sheet obstructs an entry of the following sheet into the registration conveyer and, as a result, reduces a conveyance failure of the following sheet.

Second Aspect

In the second aspect, the conveyers of the sheet processing apparatus according to the first aspect includes a preceding sheet conveyer such as the switchback conveying roller pair 13 to convey the preceding sheet P1 contacting the registration conveyer such as the pair of registration rollers 15 toward the registration conveyer. The preceding sheet conveyer conveys the preceding sheet P1 in a direction away from a path in which the following sheet P2 enters the registration conveyer (ex. the folding processing path W2) with reference to a line segment (ex. the line segment T1) connecting a nip in the preceding sheet conveyer and a nip in the registration conveyer.

As described in the first variation, the preceding sheet conveyer such as the switchback conveying roller pair 13 conveys the preceding sheet P1 to the side opposite to the path in which the following sheet P2 enters the registration conveyer (ex. the folding processing path W2) when the preceding sheet conveyer conveys an end portion of the preceding sheet P1 with a leading edge contacting the registration conveyer such as the pair of the registration rollers 15. This configuration bends the preceding sheet toward the direction in which the preceding sheet does not obstruct the entry of the following sheet to the registration conveyer, prevents the preceding sheet from plugging the path in which the following sheet P2 enters the registration conveyer, and reduces the conveyance failure of the following sheet.

Third Aspect

In the third aspect, the conveyers of the sheet processing apparatus according to the first or second aspect includes the preceding sheet conveyer such as the switchback conveying roller pair 13 to convey the preceding sheet P1 contacting the registration conveyer such as the pair of registration rollers 15 toward the registration conveyer and a guide 56 disposed between a path in which the preceding sheet enters the registration conveyer (ex. the switchback conveyance path W3) and the path in which the following sheet enters the registration conveyer (ex. the folding processing path W2) to guide the preceding sheet P1, and the guide 56 crosses the line segment T1 connecting the nip in the preceding sheet conveyer and the nip in the registration conveyer.

As described in the second aspect, this makes it possible to prevent the leading end of the preceding sheet P1 from bending toward the path in which the following sheet P2 enters the registration conveyer (ex. the folding processing conveyance path W2) when the leading edge of the preceding sheet P1 contacts the registration conveyer such as the pair of registration rollers 15. Additionally, in this configuration, the leading edge of the preceding sheet P1 in the switchback conveyance path W3 contacts the guide 56 and subsequently contacts the registration conveyer while the leading end of the preceding sheet P1 bends toward the side opposite to the path in which the following sheet P2 enters the registration conveyer. Therefore, this configuration bends the preceding sheet toward the direction in which the preceding sheet does not obstruct the entry of the following sheet to the registration conveyer, prevents the preceding sheet from plugging the path in which the following sheet P2 enters the registration conveyer, and reduces the conveyance failure of the following sheet.

Fourth Aspect

In the fourth aspect, the conveyers of the sheet processing apparatus according to any one of the first to third aspect includes the preceding sheet conveyer such as the switchback conveying roller pair 13 to convey the preceding sheet P1 contacting the registration conveyer such as the pair of registration rollers 15 toward the registration conveyer. Additionally, with a line segment T1 connecting a nip in the preceding sheet conveyer and a nip in the registration conveyer as a reference, a space on a side of a path such as the folding processing conveyance path W2 in which the following sheet enters the registration conveyer is wider than a space on a side of a path such as the switching conveyance path W3 in which the preceding sheet enters the registration conveyer.

As described in the embodiment, in this configuration, when the leading end of the preceding sheet P1 contacts the registration conveyer such as the pair of registration rollers 15 and is bent, the preceding sheet P1 bends in a large space where there is no member to restrict bending such as a guide, and the space is on the side opposite to the path in which the following sheet P2 enters the registration conveyer. Therefore, this configuration bends the preceding sheet toward the direction in which the preceding sheet does not obstruct the entry of the following sheet to the registration conveyer, prevents the preceding sheet from plugging the path in which the following sheet P2 enters the registration conveyer, and reduces the conveyance failure of the following sheet.

Fifth Aspect

In the fifth aspect, the sheet processing apparatus according to any one of the first to fourth aspect includes the entry roller pair 10 to receive the sheet from an outside of the sheet processing apparatus and a plurality of sheet conveyance paths W2*a* and W2*b* that sequentially receive the sheet conveyed from the entry roller pair 10.

As described in the fifth variation, this sheet processing apparatus gives higher productivity than the sheet processing apparatus in which the preceding sheet is returned to the path in which the preceding sheet enters the registration conveyer by using the switchback conveyance path.

Sixth Aspect

In the sixth aspect, the registration conveyer such as the pair of registration rollers 15 of the sheet processing apparatus according to any one of the first to fifth aspect conveys the preceding sheet and subsequently convey the preceding sheet in reverse toward the switchback conveyance path W3.

When the sheet processing apparatus overlays three or more sheets, this configuration can make the sheet processing apparatus smaller than the configuration which includes a plurality of sheet conveyance paths that sequentially receive the sheet conveyed from the entry roller pair.

Seventh Aspect

In the seventh aspect, the conveyers of the sheet processing apparatus according to any one of the first to sixth aspect includes a following sheet conveyer such as the conveyance roller pair 12 to convey the following sheet P2 toward the registration conveyer such as the pair of registration rollers 15. The following sheet conveyer is configured to continue to convey the following sheet P2 after the following sheet P2 contacts the registration conveyer, and the registration conveyer is configured to start conveying the following sheet P2 when a predetermined time has passed since the following sheet P2 contacts the registration conveyer.

As described in the embodiment, this makes it possible to correct the skew of the following sheet without affecting productivity.

Eighth Aspect

In the eighth aspect, the sheet processing apparatus according to any one of the first to seventh aspect includes the folding device B disposed downstream of the conveyers such as the pair of registration rollers 15 to fold the sheet.

As described in the embodiment, this makes it possible to perform the folding processing.

Ninth Aspect

In the ninth aspect, the image forming system 4 includes the image forming apparatus 3 to form the image on the sheet and the sheet processing apparatus such as the folding processing apparatus 1 to perform a predetermined process on the sheet according to any one of the first to eighth aspect.

This can reduce the occurrence of the conveyance failure.

It is to be noted that the above embodiment is presented as examples to realize the present disclosure, and it is not intended to limit the scope of the disclosure. These novel embodiments can be implemented in various other forms, and various omissions, substitutions, and changes can be made without departing from the gist of the disclosure. These embodiments and variations are included in the scope and gist of the disclosure and are included in the disclosure described in the claims and the equivalent scope thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet processing apparatus comprising:

a plurality of conveyers to convey a sheet, the plurality of conveyers including a registration conveyer to receive sequential contact from a plurality of sheets, the plurality of conveyers further including at least one conveyer configured to bend a preceding sheet of the plurality of sheets contacting the registration conveyer to an opposite side of a guide, toward a direction away from a side of the guide to which a following sheet of the plurality of sheets is conveyed, so that the preceding sheet does not obstruct an entry of the following sheet along a conveyance path to the registration conveyer, to permit sequential conveyance of the plurality of sheets to a post-processing apparatus, disposed downstream of the plurality of conveyers, to perform post-processing.

2. The sheet processing apparatus of claim 1, wherein the plurality of conveyers include a preceding sheet conveyer to convey the preceding sheet contacting the registration conveyer toward the registration conveyer, and wherein the preceding sheet conveyer is configured to convey the preceding sheet in a direction away from the conveyance path in which the following sheet enters the registration conveyer, with reference to a line segment connecting a nip in the preceding sheet conveyer and a nip in the registration conveyer.

3. The sheet processing apparatus of claim 1, wherein the plurality of conveyers include:

a preceding sheet conveyer to convey the preceding sheet contacting the registration conveyer toward the registration conveyer; and the guide, the guide being disposed between a path in which the preceding sheet enters the registration conveyer and a path in which the following sheet enters the registration conveyer, to guide the preceding sheet, and the guide crossing a line segment connecting a nip in the preceding sheet conveyer and a nip in the registration conveyer.

4. The sheet processing apparatus of claim 1, wherein the plurality of conveyers include a preceding sheet conveyer to convey the preceding sheet contacting the registration conveyer toward the registration conveyer, and wherein, with a line segment connecting a nip in the preceding sheet conveyer and a nip in the registration conveyer as a reference, a space on a side of a path in which the following sheet enters the registration conveyer is relatively wider than a space on a side of a path in which the preceding sheet enters the registration conveyer.

5. The sheet processing apparatus of claim 1, further comprising:

an entry roller pair to receive the sheet from an outside of the sheet processing apparatus, wherein a plurality of sheet conveyance paths to sequentially receive the sheet conveyed from the entry roller pair and convey the sheet to the registration conveyer.

6. The sheet processing apparatus of claim 1, wherein the registration conveyer is configured to convey the preceding sheet and is configured to subsequently convey the preceding sheet in reverse toward a switchback conveyance path.

7. The sheet processing apparatus of claim 6, wherein, upon a leading edge of the preceding sheet being conveyed toward the switchback conveyance path, the registration conveyer is configured to stop conveyance of the preceding sheet.

8. The sheet processing apparatus of claim 7, wherein, after stopping the conveyance of the preceding sheet, the registration conveyer is configured to convey the preceding sheet in the conveyance direction, and correct skew of the preceding sheet.

9. The sheet processing apparatus of claim 1, wherein the plurality of conveyers include a following sheet conveyer to convey the following sheet toward the registration conveyer, the following sheet conveyer being configured to continue to convey the following sheet after the following sheet contacts the registration conveyer, and wherein the registration conveyer is configured to start conveying the following sheet upon a time having passed since the following sheet contacts the registration conveyer.

10. The sheet processing apparatus of claim 1, further comprising a folding device, disposed downstream of the plurality of conveyers, to fold the plurality of sheets.

11. An image forming system comprising:

an image forming apparatus to form an image on a sheet; and the sheet processing apparatus of claim 1 to perform processing on the sheet.

12. The sheet processing apparatus of claim 1, wherein the registration conveyer is configured to convey the preceding sheet in the conveyance direction and subsequently reverse direction to convey the preceding sheet in a reverse direction away from the conveyance path and toward a switchback conveyance path, to thereby temporarily withdraw the preceding sheet from a conveyance path along the conveyance direction so that the preceding sheet does not obstruct conveyance of a following sheet of the plurality of sheets along the conveyance direction.

13. The sheet processing apparatus of claim 12, wherein the registration conveyer is configured to stop conveyance of the preceding sheet in the conveyance direction upon a trailing edge of the following sheet being conveyed to a fork between the conveyance path and the switchback conveyance path.

14. The sheet processing apparatus of claim 13, wherein upon the registration conveyer stopping the conveyance of the preceding sheet in the conveyance direction, a device is configured to pivot to guide the preceding sheet toward the switchback path, thereby permitting the preceding sheet to be conveyed by the registration conveyer in the reverse direction along the switchback conveyance path.

15. The sheet processing apparatus of claim 14, wherein, the registration conveyer is configured to stop conveyance of the preceding sheet in the conveyance direction along the switchback path upon a leading edge of the preceding sheet being conveyed along the switchback conveyance path to the fork between the conveyance path and the switchback conveyance path.

16. The sheet processing apparatus of claim 15, wherein, after stopping the conveyance of the preceding sheet, the registration conveyer is configured to convey the preceding sheet in the conveyance direction along the conveyance path, and correct skew of the preceding sheet before contacting a first conveyer of the plurality of conveyers, for post-processing the preceding sheet, in combination with other conveyers of the plurality of conveyers.

17. The sheet processing apparatus of claim 15, wherein the post-processing apparatus is a folding processing apparatus.

* * * * *